US005339609A

United States Patent [19]

Cerf

[11] Patent Number: 5,339,609

[45] Date of Patent: Aug. 23, 1994

[54] APPARATUS AND PROCESS FOR FILM WRAPPING PACKAGED PRODUCT

[75] Inventor: Alain A. Cerf, North Redington, Fla.

[73] Assignee: Polycerf, Inc., Largo, Fla.

[21] Appl. No.: 10,159

[22] Filed: Jan. 28, 1993

Related U.S. Application Data

[63] Continuation-in-part of Ser. No. 901,699, Jun. 22, 1992, abandoned.

[51] Int. Cl.[5] ..... B65B 9/06

[52] U.S. Cl. ..... 53/550; 53/548; 53/450

[58] Field of Search ..... 53/450, 451, 550, 551, 53/552, 548

[56] References Cited

U.S. PATENT DOCUMENTS

| | | | |
|---|---|---|---|
| 4,295,322 | 10/1981 | Kuipers | 53/450 |
| 4,419,855 | 12/1983 | Shanklin | 53/450 |
| 4,433,527 | 2/1984 | Ramsey et al. | 53/548 |
| 4,589,247 | 5/1986 | Tsuruta et al. | 53/550 |
| 4,872,302 | 10/1989 | van Eijsden et al. | 53/450 X |
| 4,945,709 | 8/1990 | Cerf | 53/450 |
| 4,947,605 | 8/1990 | Ramsey | 53/450 X |

*Primary Examiner*—James F. Coan

*Attorney, Agent, or Firm*—Walter J. Monacelli

[57] ABSTRACT

Due to variations in the thickness of the film used in wrapping packaged product and various other reasons, the wrapping film such as polyethylene, polypropylene, etc., occasionally causes uneven pulling on the film with resultant turning around or twisting of the film on the packaged product, which causes a breakdown in the wrapping operation. Such breakdowns are avoided by placing on each side of the film wrapping apparatus, a film tracking, preferably electrostatic, probe appropriately spaced from the film so as to position an electrostatic charge thereon. If the film tries to creep sideways, one side of the film is exposed much more to the static generating cone on that side and less on the other. The resultant static friction forces built up on one side of the film and less on the opposite side cause the film to creep towards the side with less static friction build up until the static forces on both sides become equal and cure or avoid the twisting procedure.

14 Claims, 3 Drawing Sheets

APPARATUS AND PROCESS FOR FILM WRAPPING PACKAGED PRODUCT

This application is a continuation-in-part of application Ser. No. 07/901,699 filed Jun. 22, 1992, now abandoned.

BACKGROUND OF THE INVENTION

1. Field of the Invention

This invention relates to apparatus and process for film wrapping a packaged product. More specifically it is related to specifically designed apparatus and process which avoid the tendency of the wrapping film to cause unevenness in the pulling of the wrapping film which results in twisting of the film. Still more specifically the apparatus and process are equipped with a pair of film tracking, preferably electrostatic, probes spaced from the film and equipped to deposit static charges on the film. These static charges on the film inhibit any tendency of the film to cause the twisting which might otherwise result.

2. State of the Prior Art

Various commercial techniques and apparatus for wrapping packaged products with film are well known. In these of film is fed into an apparatus which folds the film around the package, provides for an overlapping of longitudinally extending edges of the film at the bottom of the apparatus and an appropriate sealing thereof.

Wherever there is a pulling of the film to wrap it around the packaged product, there is the likelihood of having an uneven pulling of the film, resulting in a twisting of the film particularly along the sides of the packaged product which results in a breakdown of the wrapping operation. This uneven pulling of the film may be caused by variations in the thickness of the film, variations in the thickness of coating material on the film, variations in the coefficient of friction on the surface of the film, etc.

In applicant's parent application Ser. No. 07/901,699 a number of U.S. Patents were cited. The patents on which rejection was based were Ramsey et al U.S. Pat. Nos. 4,433,527, Cerf 4,945,709, Ramsey 4,947,605, Shankl in 4,419,855, Kuippers 4,295,322 and Borrello 4,004,399. However the disclosures of electrostatic charges in these references are directed to the sealing of overlapping edges of the wrapping film.

There is no showing in the prior art of any apparatus or process which deposits a static charge on the wrapping film to avoid uneven pulling on the wrapping film.

OBJECTIVES

It i s an object of this invention to provide apparatus and process which reduce or avoid the tendency of wrapping film to twist and cause a breakdown of the wrapping operation.

It is also an object of this invention to compensate for an unevenness or non-uniformity of the thickness of the wrapping film or other property which may cause the tendency of the film to twist.

It is also an object of this invention to compensate for an unevenness of coating material on the wrapping film which may cause the tendency for the film to twist.

It i s al so an object of this invention to compensate for variations in the coefficient of friction on the surface of the wrapping film which may cause the tendency of the film to twist.

It is also an object of this invention to compensate for these varied film properties and wrapping problems caused thereby by applying a static charge on the surface of the wrapping film.

It i s al so an object of this invention to apply a static charge on selected surfaces of the wrapping film by having two or more static probes appropriately positioned and spaced from the film.

Other objects will become obvious upon reading the detailed description of the invention as given hereinafter.

SUMMARY OF THE INVENTION

In accordance with the present invention, apparatus and process are described herein which meet all of the above objectives. The apparatus and process which effect these objectives comprise a wrapping apparatus and process which feeds wrapping film from a roll of the same, and folds this film into a tunnel seal ed at the front end into which the package is introduced with the result that the package is wrapped, and applies static charges on the film as it is being pulled around the packaged product. This wrapping apparatus herein shown and defined is more fully described and shown in my U.S. Pat. No. 4,945,709 issued Aug. 7, 1990. The static charges are applied to the film by electrostatic probes. Two probes are advantageously positioned horizontally, one on each side of the wrapping apparatus. In each case the static charge emitting end of the probe is spaced a small distance from the film. The overlapping longitudinal edges of the film positioned underneath the package are static sealed.

BRIEF DESCRIPTION OF THE DRAWINGS

The description of the apparatus and process of this invention is facilitated by reference to the accompanying drawings in which.

DETAILED DESCRIPTION OF THE INVENTION

Figure 1:
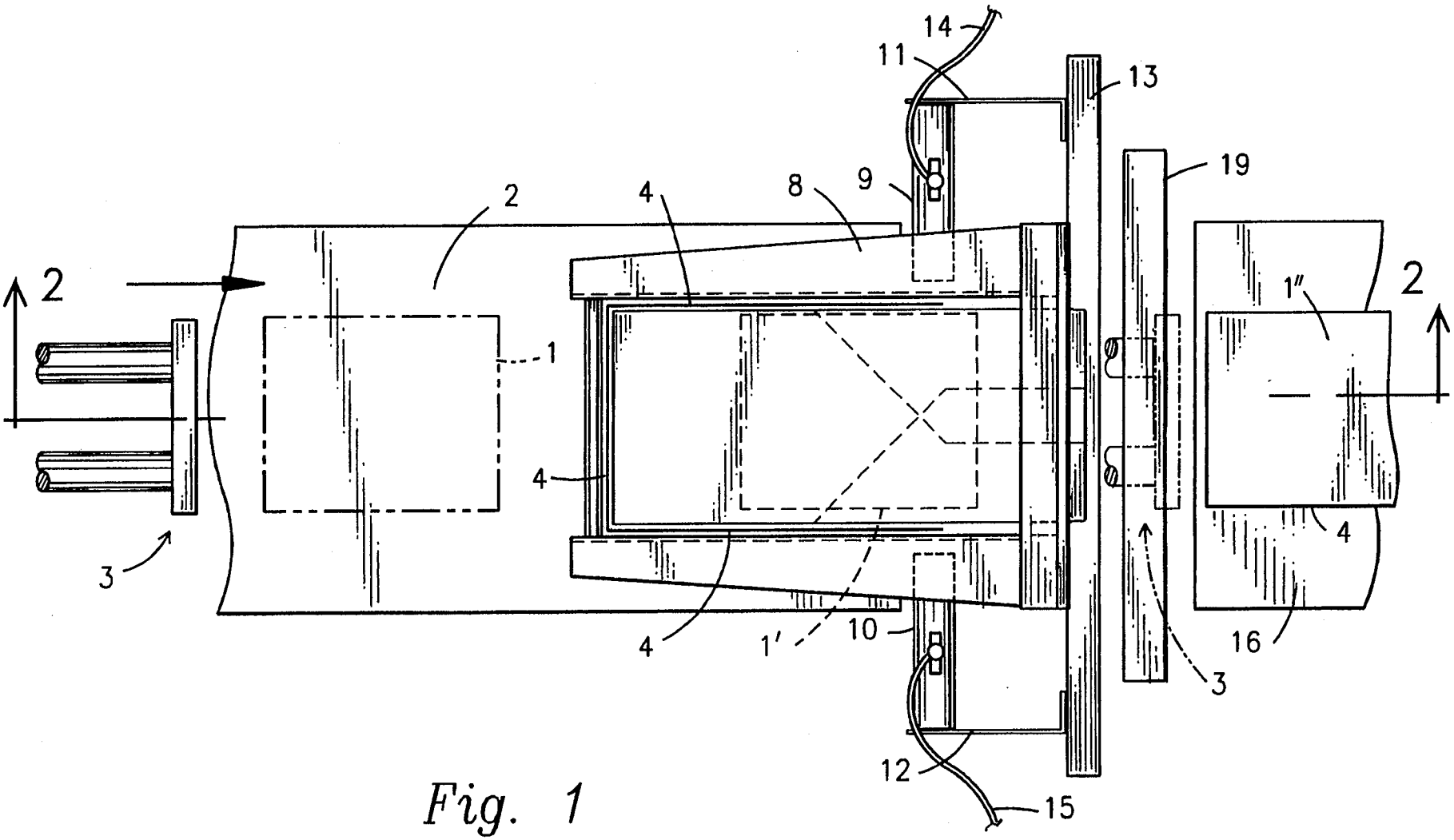
FIG. 1 is a top plan view of the apparatus of this invention.

More specifically, the packaged product 1 is pushed on table top 2 by forward movement of pneumatically driven push bar 3. Push bar 3 comprises a pair of cylindrical bars or pipes joined at one end to a flat plate which pushes against the packaged product. The bar is long enough to reach from its original position to the left of the packaged product on the top of first table 7 to its final position, adjacent table top 16 of table 17. Film 4 is fed from a roll of film (roll not shown) by standard means for effecting and controlling the feed (not shown) into forming head 5 which guides film 4 around product 1. Forming head 5 is of a standard type, more specifically disclosed in my aforementioned U.S. Pat. No. 4,945,709, used to shape a tunnel of film into which the package may be received. The packaged product is shown in phantom as 1 in its initial position and in phantom as 1' as it passes into the film tunnel inside of forming head 5 and eventually as 1'' as it is pushed to its final position. After the packaged product has reached its final position at 1", push bar 3 is retracted to its original position. When it has cleared the space beneath bar 18, heated sealing and cutting bar 18 is lowered midway where it meets rising lower bar 19 and the cutting and sealing of the end of film tunnel is completed. Forming head 5 is supported by framework 8. Additional packaged products are deposited in position 1 on table top 2 by feeding the packages from the side of table top 2 or by any other appropriate means. Electrostatic probes 9 and 10 are supported by angle irons 11 and 12 which in turn are attached to supporting structure 13. Lead cables 14 and 15 feed electricity to the probes 9 and 10 for activating the generation of electrostatic charges.

Figure 2:
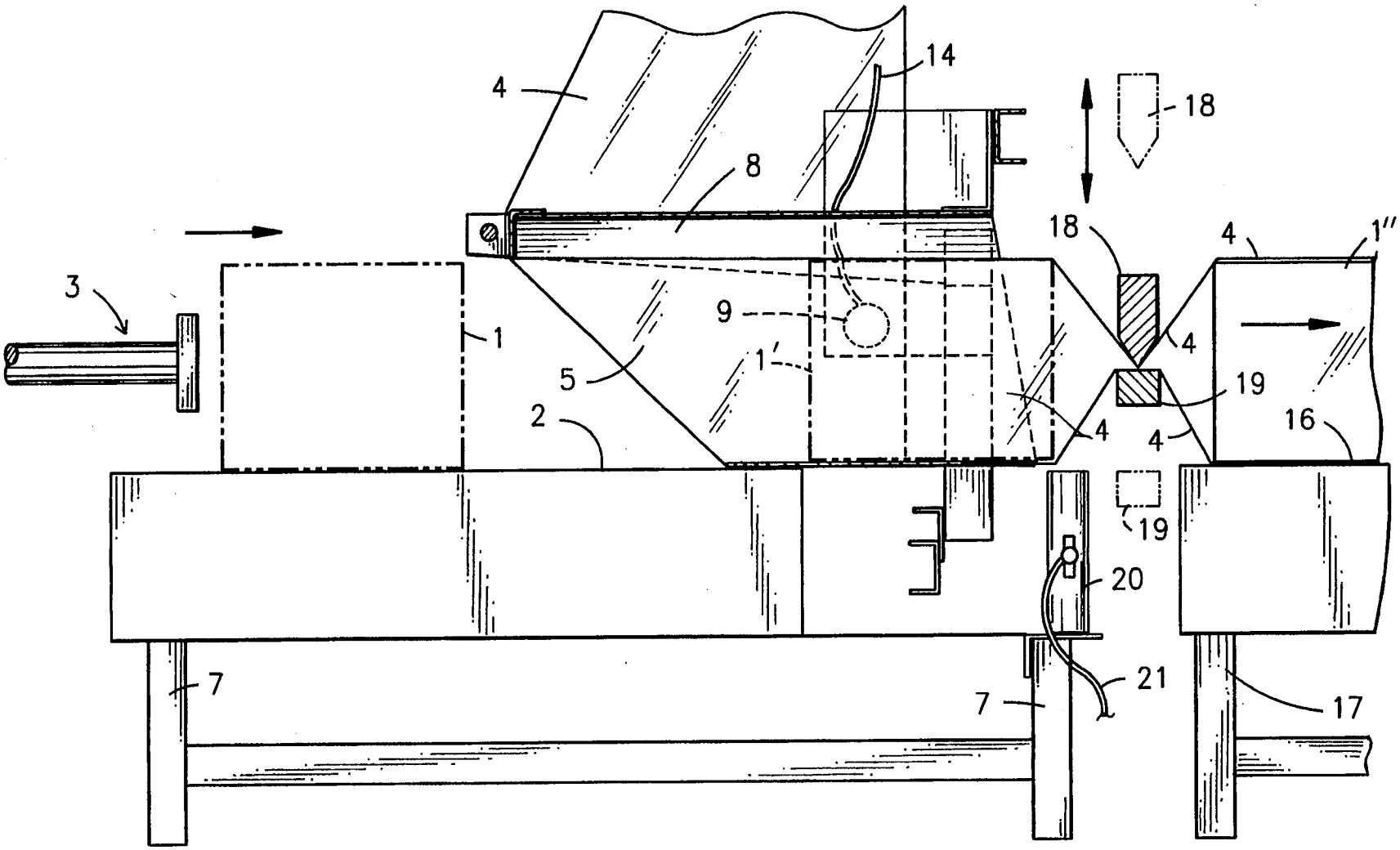
FIG. 2 is a cross-sectional elevational view of the apparatus of FIG. 1 taken at line 2—2.

FIG. 1 shows the electrostatic probes 9 and 10 arranged horizontally and aimed at the sides of the wrapping for the packaged product. These correct any defect that may cause twisting and shutdown. Probe 9 is shown in FIG. 2 and a third probe 20 arranged vertically and aimed toward the bottom of the wrapped product package is shown in FIG. 2. The third probe 20 may be omitted but it is believed of assistance in the cutting and sealing operation. Electrical cable 21 is also shown in FIG. 2.

Figure 3:
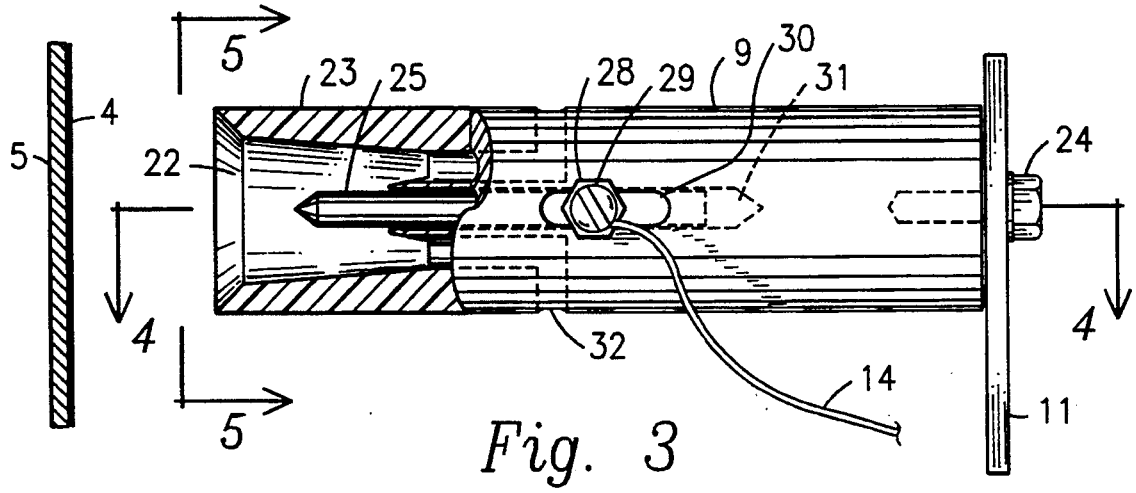
FIG. 3 is a top, partial cross-sectional view of an electrostatic probe used in this invention.
Figure 4:
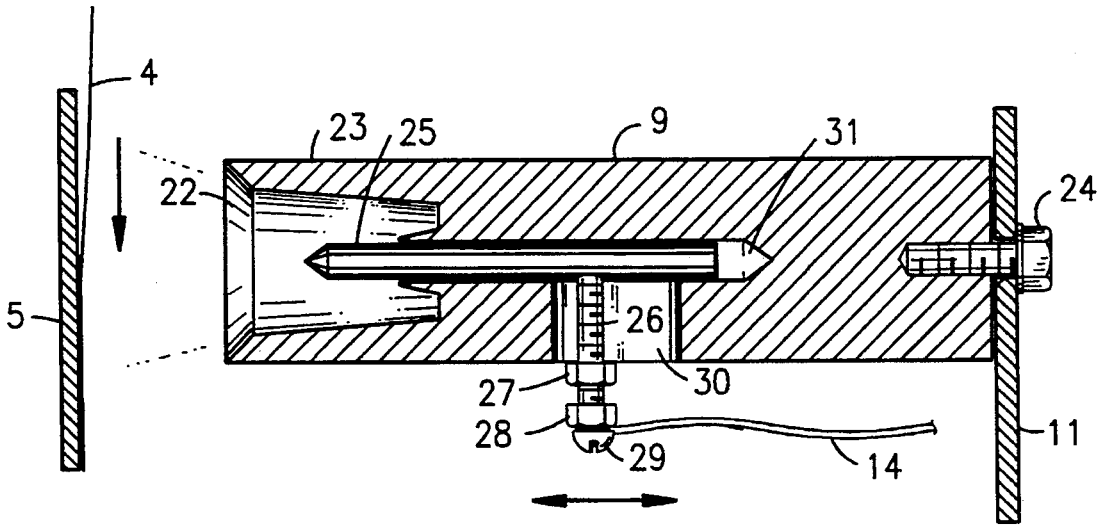
FIG. 4 is a side, elevational cross-sectional view taken at line 4—4 of FIG. 3.
Figure 5:
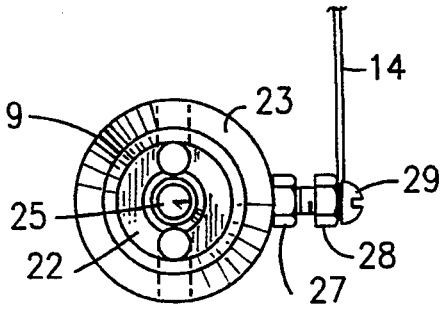
FIG. 5 is an end, elevational view taken at line 5—5 of FIG. 3.

FIGS. 3, 4 and 5 show details of typical static probe 9 used in this invention. This probe has an open end 22 with outer shroud 23. Bolt 24 holds the probe to support 11. The inside of the probe has an opening 31 which extends into the interior of the probe and is appropriately sized to receive electrode 25 which may be arranged at an appropriate position in opening 31. Bolt 26 is used to hold electrode 25 in a fixed position and is threaded into a threaded opening in electrode 25. Slot 30 is provided for changing the position of bolt 26 and electrode 25. Nut 27 may be tightened down against the exterior of probe 9 to hold the bolt 26 and electrode 25 in fixed position. Cable 14 is attached to bolt 26 and nut 28 is used to hold the bare or exposed end of cable 14 against the head 29. Clearing port 32 is also provided.

Electrode 25 is preferably made of stainless steel but may be made of other material s capable of generating and projecting the static charges desired for the purpose of this invention. Shroud 23 is preferably made of a plastic material which will protect, insulate and shield the charging electrode. A particularly effective material is the commercially available "DELRIN".

The effectiveness of the apparatus and process of this invention is shown by operating these with polyethylene film fed at a rate of about 10-100 feet per minute. When the two prongs 9 and 10 as shown in the drawings are activated, the system is operated without breakdown. When the prongs are deactivated by omitting the voltage, the number of breakdowns depend on the quality of the film, such as uneven thickness of film, uneven thickness of coating on the film, and variations in the coefficient of friction of the surface of the film.

With the prongs shown in the drawings and a voltage of 10,000–20,000 volts preferably about 14,000 volts, applied to each prong and the adjacent end of the electrode spaced 0.5–1.5 inch, preferably about one inch, from the film the electrostatic charge imposed on the film has a circular pattern of about 2–3 inches in diameter. With the film travelling through the zone of static charging the shape of the static pattern is a strip of about 2–3 inches in width.

The desired voltage is supplied from a D.C. generator. With the positive side of the D.C. voltage connected to the electrode in the prong, another lead from the negative side of the voltage source is directed to an appropriate grounding on the sides of the forming head 5. In the drawings where bolt 26 and bolt head 29 are shown extending from one side of the prong, these are either covered with an insulating means or as may be more practical, these are positioned in an area where there is not likely to be any accidental contact with these.

In the arrangement of prongs shown in the drawings the two electrostatic prongs shown at the sides of the package are effective in avoiding the twisting described herein whereby as this film moves around the product to be packaged, the electrostatic charges delivered by the prongs impinges on the film and prevents the film on each side of the package from unequally moving in and around the product such that the film remains smooth and does not disrupt operation of the packaging machine. With the electrostatic charge grounded by the sides of machine 5, the charge is effective to perform its intended purpose but is not of such a high electrostatic charge to unreasonably hinder movement of the film in its path toward enveloping the packaged product moving through the machine from its entry till its exit in incapsulated condition.

In place of the above-described arrangement in which a pneumatic push bar is used to push the packaged product through its various positions, it is contemplated that other means and methods may be used to effect these transfers. Nevertheless the disadvantage of film twisting still exists and the advantages of the static depositions to avoid twisting are also applicable in such cases.

For larger packages where wider film may be used it will be appropriate to use more than two prongs to deposit static charges on the film. In addition to one individual package a composite of a number of small packages, or rolls or cans may be used with appropriate means to hold them in position.

In addition to polyethylene films other films suitable for wrapping may be used such as polypropylene, polyvinylchloride, co-extruded polyethylene-polypropylene, etc.

While certain features of this invention have been described in detail with respect to embodiments thereof and especially as relates to the use of an electrostatic charge for impingement on the film, it will of course be apparent that other modifications can be made within the spirit and scope of this invention and it is not intended to limit the invention to the exact details shown above except insofar as they are defined in the following claims.

The invention claimed is:

1. An apparatus for use in the operation of encasing a package in a plastic film, including a forming head onto which a plastic film is moved to form a generally tubular cavity into which the package is projected for the eventual encasement of said package, said forming head including opposite side members over which the film flows and means disposed on opposite sides of said members with the film disposed between said members and said means, whereby said means produce a static charge between said means and side members to impose a light load between said film and side members to effectively slightly impede the free movement of the film in its package encasing function.

2. An apparatus according to claim 1 wherein said static charge is electrostatic in nature.

3. An apparatus according to claim 2 wherein said static charge producing means includes electrical power fed electrodes one on each side of the side members with the charge flowing substantially horizontally between the electrodes and said side members.

4. An apparatus according to claim 3 wherein the discharge end of each electrode is disposed approximately one inch from the film.

5. An apparatus according to claim 4 wherein the side members provide a ground for the electrodes.

6. An apparatus which employs means for applying resistance to the sides of a flexible film of the type used to wrap packages, said film defining a generally tubular cavity means comprising:

means disposed on opposite sides of said cavity means effective to impinge a load on said film wherein said means disposed on opposite sides of said cavity includes a static charge producing unit on each side of said cavity.

7. An apparatus according to claim 6 wherein each of said static producing units is electrostatic in nature.

8. An apparatus according to claim 7 wherein the said electrostatic units each include an electrode supplied voltage from electrical power source.

9. An apparatus according to claim 8 wherein the electrodes are supported at a prescribed distance from the film effective to project an electrostatic charge horizontally over a predetermined portion of the film.

10. An apparatus according to claim 9 wherein the discharge end of each electrode is horizontally positioned approximately 1" from the film.

11. An apparatus according to claim 10 wherein the electrostatic charge is impinged on the film over approximately an area of 8 square inches.

12. An apparatus which employs means for impinging a static charge to the sides of a flexible film of the type used to wrap packages, said film being fed to the apparatus in a manner to define a generally tubular cavity body comprising:

a pair of electrostatic charge producing means, one disposed on each side of said tubular cavity body.

13. An apparatus according to claim 12 wherein said apparatus includes means having side members internally of the tubular cavity body juxtaposed the side positions of the cavity body for supporting the film in its movement toward encasing said package and providing a ground for the electrostatic charge being impinged on the side portions of said cavity body.

14. An apparatus according to claim 13 wherein said electrodes are supplied a voltage in the range between 10,000 and 20,000 volts effective to provide an electrostatic charge at the electrode discharge point impinging on the film and place a light restraint in its normal movement along the side portions of the apparatus.

* * * * *